US006419555B1

(12) United States Patent
Goers

(10) Patent No.: US 6,419,555 B1
(45) Date of Patent: Jul. 16, 2002

(54) PROCESS AND APPARATUS FOR POLISHING A WORKPIECE

(76) Inventor: Brian D. Goers, 3333 Holmes Ave. South, Minneapolis, MN (US) 55408

( * ) Notice: Subject to any disclaimer, the term of this patent is extended or adjusted under 35 U.S.C. 154(b) by 21 days.

(21) Appl. No.: 09/585,496

(22) Filed: Jun. 1, 2000

Related U.S. Application Data

(60) Provisional application No. 60/137,306, filed on Jun. 3, 1999, now abandoned.

(51) Int. Cl.[7] ..... B24B 1/00
(52) U.S. Cl. ..... 451/41; 451/398; 451/269
(58) Field of Search ..... 451/41, 267, 269, 451/285, 398

(56) References Cited

U.S. PATENT DOCUMENTS 3,453,783 A * 7/1969 Queen ..... 51/216
4,739,589 A 4/1988 Brehm et al.
5,882,245 A * 3/1999 Popovich et al. ..... 451/41
6,030,280 A * 2/2000 Fruitman ..... 451/291
6,139,408 A * 10/2000 Hakomori ..... 451/267

* cited by examiner

*Primary Examiner*—Timothy V. Eley
*Assistant Examiner*—Dung Van Nguyen
(74) *Attorney, Agent, or Firm*—Crompton, Seager & Tufte, LLC

(57) ABSTRACT

A process for abrasive machining of wafer-like workpieces, especially semiconductor wafers. The process uses carrier disks in which the outer periphery on which the driving forces mesh, is made of a material having a tensile strength of at least 100 N/mm$^2$, while in the area that comes into contact with the workpieces to be machined, there is provided a plastic material, preferably having an elasticity modulus of from 1.0 to $8\times10^4$ N/mm$^2$. The plastic material is preferably secured to the carrier disk by a layer of adhesive positioned parallel to a surface of the carrier disk. In particular, the plastic material is laminated into the carrier disk.

8 Claims, 1 Drawing Sheet

PROCESS AND APPARATUS FOR POLISHING A WORKPIECE

CROSS REFERENCE TO CO-PENDING APPLICATIONS

This application claims priority under 35 U.S.C. §119(e) (1) to U.S. Provisional Application Ser. No. 60/137,306, filed Jun. 3, 1999 now abandoned.

FIELD OF THE INVENTION

The present invention is directed to an apparatus and a process for polishing or machining workpieces, particularly wafers such as semi-conductor wafers.

BACKGROUND OF THE INVENTION

With the rapid growth of the computer industry, competition for computer components has escalated. The price of producing chips can be decreased by increasing the number of chips processed simultaneously. Further, additional capacity can be realized if both sides of the chip are processed (for example, polished) simultaneously. Capacity, and realized cost, can be increased by minimizing the number of damaged or defective chips or wafers. There have been numerous machines disclosed directed at improved wafer processing. For example, a bilateral polishing or lapping process for semiconductor wafers is described in U.S. Pat. No. 3,691,694 and in an article published in the IBM Technical Disclosure Bulletin, Vol. 15, No. 6,of November 1972,pages 1760–1761 (authors: F. E. Goetz and J. R. Hause). In these publications, carrier disks made of a metal, such as steel plate, or consisting entirely of plastic material are disclosed.

Although metal carrier disks provide long service life, in the course of the machining operation, and especially in the case of semiconductor wafers that are often brittle and sensitive to mechanical stresses, the edges of the wafer are damaged and thus, a large portion of the machined wafers cannot be used. It has been realized that this edge damage does not appear in wafers machined using carrier disks made of plastic material. However, as mentioned above, the service life of plastic carrier disks is short. The external periphery of plastic carrier disks cannot withstand the mechanical stresses caused by a drive unit comprising planetary gearing.

The object of the present invention is to provide an apparatus and a process that allows bilateral abrasive machining, such as lapping or polishing, of wafer-like workpieces that causes low mechanical stressing of the edge of the workpiece together with a long service life of the carrier disks.

SUMMARY OF THE INVENTION

According to the present invention, an apparatus and a process for bilateral abrasive machining of brittle and stress sensitive material is provided. The apparatus comprises a carrier disk wherein at least the outer periphery is made of a first material and the portion of the carrier disk that comes into contact with the external periphery of the workpiece comprises a plastic material. The plastic material may be formed as an insert that is held within the first material of the carrier disk by at least one layer of adhesive. The adhesive extends parallel to the surface of both the first material and the plastic material, and may cover the entire surface of the carrier disk. That is, the plastic insert is preferably laminated to the first material of the carrier disk. In some embodiments, a layer of adhesive extends parallel to each of opposite first and second surfaces of both the first material and the plastic material. In such an embodiment, the first material and plastic material would be laminated between the two adhesive layers. The strength of the adhesive layer(s) is sufficient to retain the plastic insert securely in the first material.

In one embodiment, the first material may have a tensile strength of at least 100 $N/mm^2$. In another embodiment, the plastic material which contacts the workpiece may have an elastic modulus of about 1.0 to $8.10^4$ $N/mm^2$. However, other materials, with different tensile strengths and elastic moduli, may be used.

In particular, the present invention is directed to an apparatus for use in the machining of a workpiece, such as a silicon wafer or the like. The apparatus comprises a planar carrier disk which comprises a first portion comprising a base plate and a second portion within a first aperture within the first portion. The first aperture is configured and adapted to receive the second portion. The carrier disk or first portion may have a serrated outer periphery. The second portion comprises a second aperture therein, the aperture configured and adapted to receive a workpiece such as a silicon wafer. The second portion comprises a plastic material, which is held within the second portion by at least one layer of adhesive extending across both the first portion and the second portion. Optionally, two layers of adhesive may be used, one on each side of the carrier disk. Preferably, a cross-section of the apparatus at the second portion comprises a first adhesive layer, a plastic layer, and a second adhesive layer.

DETAILED DESCRIPTION OF THE INVENTION

The process of the present invention is carried out under conditions familiar to a technician using conventional machines for bilateral polishing or lapping of wafer-like workpieces. The process is especially suited for the abrasive machining of wafers made of crystalline material such as semiconductor wafers of silicon, germanium, gallium arsenide, gallium phosphide, indium phosphide, or wafers made of oxide material such as gallium-gadolinium-garnet. It can also be used for the abrasive machining of wafer-like workpieces of brittle materials such as glass. Rigid disks, such as nickel plated aluminum rigid disks, nickel coated glass rigid disks, and glass and glass ceramic rigid disks, may also be processed in accordance with the present invention.

Figure 1:
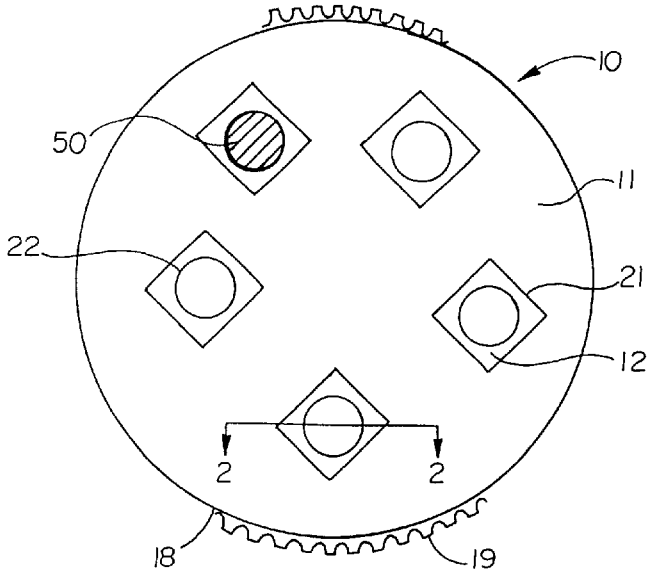
FIG. 1 is a top perspective view of a carrier disk according to the present invention.

Reference is now made to the Figures where like elements are referred to by like numerals throughout the various views. As illustrated in FIG. 1, an apparatus of the present invention generally comprises a carrier disk 10 having a first portion 11 and a second portion 12. The first portion 11 occupies the majority of the area of the carrier disk 10 and provides the outer periphery 18 of the carrier disk 10. The outer periphery 18 may include serrations or teeth 19, which are designed to mesh or otherwise interact with a structure on the machine to drive the carrier disk. Within the first portion 11 is at least one aperture 21, in which is retained second portion 12. Second portion 12 has a second aperture 22, and second portion 12 contacts the periphery of the workpiece 50 being polished or machined at second aperture 22. Second portion 12 is constructed to securely retain workpiece 50 during the polishing operation.

Suitable materials for fabrication of the first portion 11 are materials that have sufficient mechanical strength in relation to the mechanical stresses caused by the drive of the machine used, chiefly tensile and pressure stresses. Suitable materials includes metals such as aluminum and steels, which may possess in general, a tensile strength of at least about 100 $N/mm^2$preferably at least about 1000 $N/mm^2$. Care should be taken to select the materials that are as resistant as possible to the abrasive used, for example the abrasive slurry or suspension. The first portion material should be resistant to the polishing and lapping materials in order to prolong the life of the carrier disk 10 and to reduce as much as possible contamination of the workpieces to be machined. Plastic materials of sufficient tensile strength, such as some types of bakelite and fiber-reinforced materials, may be used to form first portion 11 of carrier disk 10.

Suitable materials for fabrication of the second portion 12, which contacts the external periphery of the workpiece 50, are materials which are sufficiently elastic to ensure low mechanical stress on the periphery of the workpiece and which have sufficient mechanical strength to ensure sufficient support for the workpiece during the machining operation. Generally, suitable compositions are plastic materials having an elastic modulus range of about 1.0 to $8–10^4$ $N/mm^2$. Thermoplastic and thermosetting plastic materials may be suitable. Materials that comprise polyvinyl chloride, polypropylene, polyethylene, polycarbonate, nylon, polyester, or polytetrafluoroethylene are particularly preferred.

Carrier disk 10 of the present invention typically, although depending on the thickness of the workpiece, comprises first portion 11 having a thickness range of about 150 to 850 micrometers ($\mu$m). Both carrier disk 10 and first portion 11 can be designed in different ways. In one embodiment, carrier disk 10 may comprise a round base plate made of metal, preferably a steel plate. Aperture 21 in first portion 11 is configured and adapted to accept therein second portion 12. FIG. 1 shows aperture 21 as square, but aperture 21 may be circular, triangular, pentagonal, or any polygon shape.

Second portion 12 typically comprises a flat body of plastic material. This plastic material (second portion 12) is sized and shaped to fit within first aperture 21 and to receive a workpiece 50 in second aperture 22. Second portion 12 is typically a flat body, such as a plastic ring, having a width of from 1 to 10 mm and an external diameter conveniently selected to be slightly smaller than the inner diameter of the aperture 21 of the carrier disk 10. The thickness of second portion 12 is preferably the same as first portion 11, however, in some embodiments it may be desired to have second portion 12 thinner or thicker than first portion 11. A loose fit of second portion 12 into aperture 21 of first portion 11 may permit rotation of second portion 12 as a result of the slight play. Aperture 22 in second portion 12, similar to aperture 21 in first portion 11, may be any polygon shape, for example, circular, square, triangular, pentagon, etc.

Optionally, the apertures 21, 22 may be shaped conically inwardly running instead of vertical to provide a tighter fit. In the case of round workpieces, aperture 22 of second portion 12 may be slightly larger than the external diameter of the workpiece 50, so as to have a clearance for movement of the workpiece, such as rotation, as discussed above. Both the first portion 11 and the plastic second portion 12 of the carrier disk 10 can be easily produced by stamping from metal, preferably steel plate and from plastic, preferably polyvinyl chloride sheets, in the desired shape, and suitable thickness.

Figure 2:
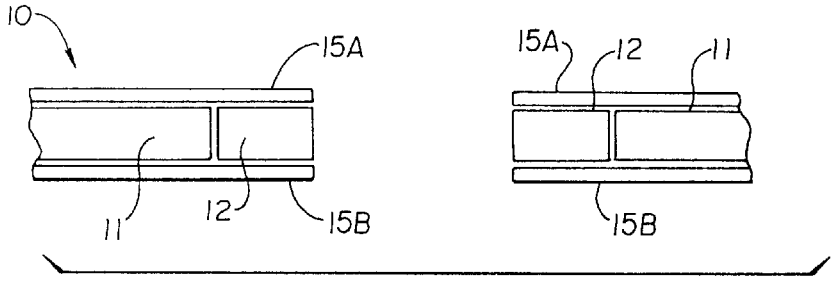
FIG. 2 is a cross-sectional side view of a portion of the carrier disk of FIG. 1, taken along line 2—2 of FIG. 1.

Second portion 12 is secured and retained in first portion 11 by at least one layer of adhesive that extends from first portion 11, across aperture 21 to second portion 12. The adhesive layer may or may not extend across the entire surface area of either first portion 11 or second portion 12, although it is preferable that surface of carrier disk 10 is planar, or, slightly depressed at second portion 12. Referring now to FIG. 2, a cross-sectional view of a carrier disk 10 is shown with first portion 11 and second portion 12 laminated between a first and second layer 15A, 15B of adhesive. In some embodiments, it may be desired to use only one adhesive layer 15 to secure second portion 12 into first portion 11.

A single sided tape is a preferred form of adhesive layer 15 used in carrier disk 10. Alternately, a coating of adhesive may be applied to the first and second portions 11, 12 after which a film layer is added to provide strength and stability to the construction. Some adhesives may be sufficiently strong and not need a film layer to provide additional strength. Types of useable adhesives include, but are not limited to, epoxies, acrylates and methacrylates, urethanes, acrylics, latex and rubbers. Typical film layers include polymer film, such as, for example, polyethylene, polypropylene, polyester, polycarbonate, polyurethane, or polyvinyl chloride film.

The carrier disk 10 of the present invention is particularly useful in the machining of workpieces that are not circular. Examples are wafers with a square cross-section of cast, directionally solidified silicon, which are used as a basic material of solar cells, or wafers from the semiconductor material recovered from a boat growth process such as gallium or indium phosphide. Instead of plastic rings, round plastic disks having square, rectangular, polygonal, elliptic or oval openings can be used. Although the workpieces introduced in the openings are held in a position fixed in relation to the rotatable plastic disk and variable only within the respective clearance, they remain rotatable together with the plastic disk within the openings of the carrier disk during the machining operation. Thus, an improved geometry in comparison with traditional processes can be obtained with these materials.

Figure 3:
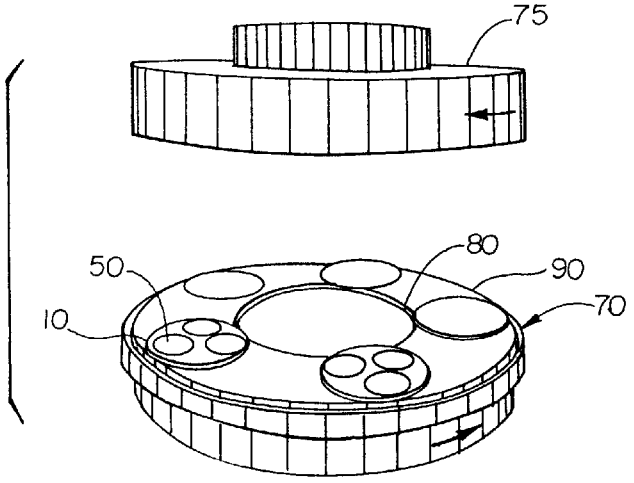
FIG. 3 is a schematic perspective view of a known bilateral polishing device.

FIG. 3 schematically illustrates a known bilateral polishing device with the carrier disks 10 with the workpieces 50 mounted between the inner and outer planetary gears 80 and 90 on a polishing table 70, on which the polishing plate 75 can be lowered during the polishing process. An abrasive source, either a fixed abrasive article or a loose slurry, is provided on at least one of polishing table 70 and polishing plate 75 so that at least one surface of workpiece 50 is polished or otherwise machined during the process. Often, polishing table 70 and polishing plate 75 rotate in opposite directions from each other. Polishing devices such as shown in FIG. 3 are well known in the art. Basically, any polishing or machining assembly or system that is adapted to polish wafer-like workpieces is contemplated for use with this invention.

Referring again to FIG. 1, another suitable embodiment of a carrier disk for carrying out the process according to the invention, comprises a round carrier disk 10 having a metal first portion 11 and a second plastic portion 12 having suitable openings for receiving the workpiece to be abrasively machined. In such carrier disks 10, a firm attachment between metal first portion 11 and plastic second portion 12 has been found useful to ensure reliable transmission of the rotating movement predetermined by the drive to the workpiece 50 mounted in the carrier disk 10. This attachment is provided by at least one layer of adhesive laminating the first portion 11 to the second portion 12. The adhesive layer is generally parallel to the top and/or bottom surfaces of the first portion 11 and second portion 12.

The carrier disks 10 of the invention can be manufactured by filling an area of a metal first portion 11 (e.g., a surrounding metal ring blanked out from a steel plate) with a plastic insert second portion 12 (e.g., a stamped or injection die cast polypropylene piece). The two portions are secured with at least one layer of adhesive extending over each first and second portions. The adhesive layer may extend over the entire area of first and second portions. Openings or apertures 22 to receive the workpieces are provided in the second portion 12.

A carrier disk according to the present invention was prepared by laser cutting 103.4 mm diameter circular holes during the fabrication of a 0.015 inch thick 1075 spring steel carrier plate. Circular polyester plastic inserts, having a diameter of 103 mm and 0.015 inch thick, were produced by steel rule die stamping commercially available polyester film. These inserts were placed into the 103.4 mm diameter holes in the steel carrier disk. The polyester inserts and spring steel carrier plate were then laminated between two layers of single sided polyester/rubber general industrial tape having a 0.0041" total thickness (commercially available from 3M under the trade designation "396"). The roll laminator used was a Ledco Econocraft 25 (manufactured by Ledco Inc., of Hemlock, N.Y.). Holes, 95.6 mm in diameter, were then cut out of the laminated polyester/steel carrier with a steel rule die.

The above specification, examples and data provide a complete description of the manufacture and use of the composition of the invention. Since many embodiments of the invention can be made without departing from the spirit and scope of the invention, the invention resides in the claims hereinafter appended.

What is claimed:

1. An apparatus for the machining of a workpiece, the workpiece having an upper and lower surface, a periphery, and a thickness, the apparatus comprising:

(a) a planar carrier disk comprising:

(i) a first portion comprising a base plate having a thickness less than the workpiece thickness, said first portion having a serrated outer periphery and at least one aperture therein, the aperture configured and arranged to receive a second portion;

(ii) the second portion comprising a plastic material and having an aperture therein, the aperture configured and arranged to receive a workpiece, wherein the second portion is in the aperture of the first portion;

(iii) a first adhesive layer positioned on a first surface of the first portion and on a first surface of the second portion, wherein the adhesive layer comprises an adhesive layer on a film carrier; and (b) a polishing system comprising an abrasive source and a system for imparting relative motion between the abrasive source and the planar carrier disk.

2. The apparatus according to claim 1, further comprising a second adhesive layer positioned on a second surface opposite the first surface of the first portion and on a second surface opposite the first surface of the second portion.

3. The apparatus according to claim 1, wherein the carrier disk comprises a material having a tensile strength of at least 100 $N/mm^2$.

4. The apparatus according to claim 1, wherein the plastic material has an elastic modulus of 1.0 to $8\times10^4$ $N/mm^2$.

5. The apparatus according to claim 1, wherein the first portion has a plurality of apertures therein, each aperture configured and arranged to receive a second portion.

6. A process for the bilateral abrasive machining of workpieces having an upper and lower surfaces and a periphery, the process comprising:

selecting a carrier disk having a plastic insert attached within an aperture in the carrier disk by laminating a film layer, the inserts having an aperture for receiving the workpiece;

mounting the workpiece in the aperture in the carrier disk; and rotating the carrier disk in relation to an abrasive so that at least one of the upper and lower surfaces contacts the abrasive.

7. The process according to claim 6, wherein both the upper surface and lower surfaces of the workpiece contact the abrasive.

8. The process according to claim 6, wherein the carrier disk comprises a material having a tensile strength of at least 100 $N/mm^2$.

* * * * *